US011624531B2

(12) United States Patent
Shoemaker

(10) Patent No.: US 11,624,531 B2
(45) Date of Patent: Apr. 11, 2023

(54) OIL CONTROL SYSTEM AND METHOD FOR HVAC SYSTEM

(71) Applicant: CARRIER CORPORATION, Palm Beach Gardens, FL (US)

(72) Inventor: Mark W. Shoemaker, Brownsburg, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 135 days.

(21) Appl. No.: 17/255,275

(22) PCT Filed: May 15, 2019

(86) PCT No.: PCT/US2019/032405

§ 371 (c)(1),
(2) Date: Dec. 22, 2020

(87) PCT Pub. No.: WO2019/245675

PCT Pub. Date: Dec. 26, 2019

(65) Prior Publication Data

US 2021/0123639 A1 Apr. 29, 2021

Related U.S. Application Data

(60) Provisional application No. 62/688,660, filed on Jun. 22, 2018.

(51) Int. Cl.

| | |
|---|---|
| ***F25B 13/00*** | (2006.01) |
| ***F25B 41/22*** | (2021.01) |
| ***F25B 31/00*** | (2006.01) |

(52) U.S. Cl.

CPC ..... *F25B 13/00* (2013.01); *F25B 41/22* (2021.01); *F25B 31/004* (2013.01);
(Continued)

(58) Field of Classification Search

CPC ..... F25B 13/00; F25B 41/22; F25B 31/004; F25B 2500/16; F25B 2500/26;
(Continued)

(56) References Cited

U.S. PATENT DOCUMENTS

| | | | |
|---|---|---|---|
| 4,441,331 | A | 4/1984 | Yuyama |
| 6,539,734 | B1 | 4/2003 | Weyna |

(Continued)

FOREIGN PATENT DOCUMENTS

| | | | |
|---|---|---|---|
| CN | 104329839 | A | 2/2015 |
| CN | 105444448 | A | 3/2016 |

(Continued)

OTHER PUBLICATIONS

Author Unknown; "Discharge Bypass Valves for System Capacity Control"; Sporlan; Parker; Bulletin 90-40; Mar. 2011; 20 Pages.

(Continued)

*Primary Examiner* — Henry T Crenshaw
*Assistant Examiner* — Kamran Tavakoldavani
(74) *Attorney, Agent, or Firm* — Cantor Colburn LLP

(57) ABSTRACT

A HVAC system that includes a compressor comprising a suction port and a discharge port. Also included is a refrigerant circulating throughout the HVAC system and through the compressor. Further included is a pressure equalization valve fluidly coupling the discharge port of the compressor with the suction port of the compressor, the pressure equalization valve configured to open while the compressor is operating.

12 Claims, 2 Drawing Sheets

(52) U.S. Cl.
CPC ... *F25B 2500/16* (2013.01); *F25B 2600/0261* (2013.01); *F25B 2700/21151* (2013.01); *F25B 2700/21152* (2013.01)

(58) Field of Classification Search
CPC .... F25B 2600/0261; F25B 2700/21151; F25B 2700/21152; F25B 31/002
See application file for complete search history.

(56) References Cited

U.S. PATENT DOCUMENTS

| | | | | |
|---|---|---|---|---|
| 7,260,951 | B2 | 8/2007 | Monk et al. | |
| 7,992,399 | B2 | 8/2011 | Monk et al. | |
| 7,997,097 | B2 | 8/2011 | Nakamura et al. | |
| 9,353,975 | B2 | 5/2016 | Takayama et al. | |
| 9,416,788 | B2 | 8/2016 | Oda et al. | |
| 9,939,184 | B2 | 4/2018 | Yura et al. | |
| 2011/0113797 | A1 | 5/2011 | Peyaud et al. | |
| 2015/0159927 | A1 | 6/2015 | Hancock | |
| 2016/0209088 | A1 * | 7/2016 | Shimazu | F25B 49/02 |
| 2017/0175743 | A1 | 6/2017 | Dunn et al. | |
| 2018/0073786 | A1 | 3/2018 | Ote | |
| 2018/0142931 | A1 * | 5/2018 | Takagi | F24F 11/36 |
| 2019/0056155 | A1 * | 2/2019 | Ishiyama | F25B 13/00 |

FOREIGN PATENT DOCUMENTS

| | | | | |
|---|---|---|---|---|
| CN | 106969524 | A | 7/2017 | |
| DE | 19520757 | A1 | 12/1995 | |
| EP | 1806549 | A1 | 7/2007 | |
| EP | 3136010 | A1 * | 3/2017 | F25B 13/00 |
| EP | 3136010 | A1 | 3/2017 | |
| JP | 2002349458 | A | 12/2002 | |

OTHER PUBLICATIONS

International Search Report and Written Opinion for Application No. PCT/US2019/032405; dated Aug. 30, 2019; 14 Pages.

* cited by examiner

OIL CONTROL SYSTEM AND METHOD FOR HVAC SYSTEM

CROSS-REFERENCE TO RELATED APPLICATIONS

This application is a 371 U.S. National Stage application of PCT/US2019/032405, filed May 15, 2019, which claims the benefit of U.S. Provisional Application No. 62/688,660, filed Jun. 22, 2018, both of which are incorporated by reference in their entirety herein.

BACKGROUND

This disclosure relates generally to heating, ventilation, and air conditioning (HVAC) systems and, more particularly, to a method of oil control within such systems.

Oil management is critical to the reliability of a compressor in variable speed systems. Furthermore, at start up or defrost in low ambient conditions, the oil discharge rate can be high and lead to oil being pumped out of the compressor, which causes premature bearing wear. The oil pump out phenomenon is caused by low temperatures and high refrigerant-oil solubility. Compressor manufacturers require a discharge superheat during operation to maintain a low refrigerant-oil solubility.

BRIEF SUMMARY

Disclosed is a method of managing compressor oil for a HVAC system. The method includes fluidly coupling a discharge port of a compressor with a suction port of the compressor with a pressure equalization valve. The method also includes operating the compressor while the pressure equalization valve is open.

In addition to one or more of the features described above, or as an alternative, further embodiments may include that the pressure equalization valve is open during a startup operation of the compressor.

In addition to one or more of the features described above, or as an alternative, further embodiments may include that the pressure equalization valve is open for a predetermined time period, the predetermined time period based at least partially on an operating condition of the compressor.

In addition to one or more of the features described above, or as an alternative, further embodiments may include that the pressure equalization valve is open for a predetermined time period, the predetermined time period based at least partially on ambient conditions.

In addition to one or more of the features described above, or as an alternative, further embodiments may include that the pressure equalization valve is closed when the discharge superheat of compressor refrigerant exceeds a threshold superheat of the compressor refrigerant.

In addition to one or more of the features described above, or as an alternative, further embodiments may include that the threshold superheat of the compressor refrigerant ranges from 5 degrees Celsius to 60 degrees Celsius.

In addition to one or more of the features described above, or as an alternative, further embodiments may include that the threshold superheat of the compressor is 20 degrees Celsius.

In addition to one or more of the features described above, or as an alternative, further embodiments may include that the method is utilized with a residential HVAC system.

Also disclosed is a HVAC system that includes a compressor comprising a suction port and a discharge port. Also included is a refrigerant circulating throughout the HVAC system and through the compressor. Further included is a pressure equalization valve fluidly coupling the discharge port of the compressor with the suction port of the compressor, the pressure equalization valve configured to open while the compressor is operating.

In addition to one or more of the features described above, or as an alternative, further embodiments may include that the pressure equalization valve comprises an inlet, a first outlet and a second outlet, the first outlet leading to a vapor line, the second outlet leading to the suction port of the compressor.

In addition to one or more of the features described above, or as an alternative, further embodiments may include that the pressure equalization valve is configured to open for a predetermined time period, the predetermined time period based at least partially on at least one of an operating condition of the compressor and ambient conditions.

In addition to one or more of the features described above, or as an alternative, further embodiments may include that the pressure equalization valve is configured to close when the discharge superheat of compressor refrigerant exceeds a threshold superheat of the compressor refrigerant.

In addition to one or more of the features described above, or as an alternative, further embodiments may include that the threshold superheat of the compressor refrigerant ranges from 5 degrees Celsius to 60 degrees Celsius.

In addition to one or more of the features described above, or as an alternative, further embodiments may include that the threshold superheat of the compressor is 20 degrees Celsius.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
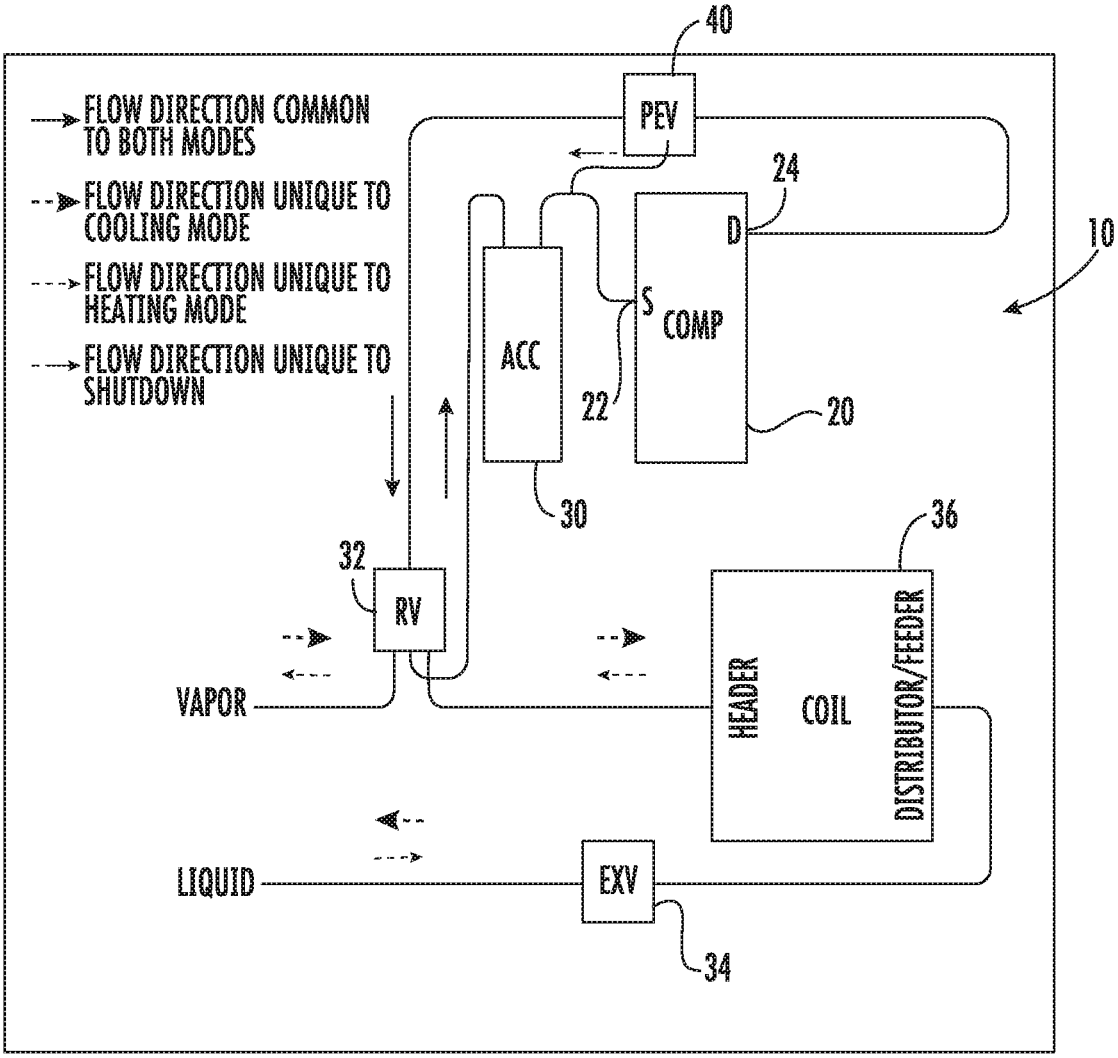
FIG. 1 is a schematic illustration of a refrigeration system.

FIG. 1 is a diagram that shows an embodiment of a refrigeration system that is referenced generally with the numeral 10. In some embodiments, the refrigeration system 10 is part of a heating, ventilation and air conditioning (HVAC) system (e.g., residential, commercial, or transport). However, it is to be understood that the embodiments described herein may benefit various other environmental control applications.

As shown in FIG. 1, the refrigeration system 10 includes an electrically-powered compressor 20 powered by a motor. The compressor 20 drives a refrigerant flow along a refrigerant flowpath entering the compressor at a suction port 22 and exiting the compressor 20 at a discharge port 24. The various illustrated lines may be of conventional refrigerant line/conduit construction.

The refrigeration system 10 includes an accumulator 30 and one or more switching valves 32 for switching between the heating mode and the cooling mode. In the heating mode, a flow of refrigerant is compressed by the compressor 20 and passes along a refrigerant flowpath from the discharge port 24 through the switching valve 32 along a vapor line to a first heat exchanger (not shown), such as an indoor heat exchanger. In this mode, the first heat exchanger serves as a heat rejection heat exchanger rejecting heat to the air flow (e.g., acting as a condenser or gas cooler). The cooled refrigerant flow then passes along a liquid line and through an expansion device 34 to a second heat exchanger 36 (e.g., outdoor heat exchanger) which therefore serves conventionally as a heat absorption heat exchanger or evaporator absorbing heat from the air flow. The refrigerant then returns via the valve 32 and accumulator 30 to the suction port 22. The cooling mode generally reverses direction of flow through the heat exchanger(s).

A pressure equalization valve 40 connects the discharge port 24 and the suction port 22 of the compressor 20. The pressure equalization valve 40 is employed to equalize the pressure when the compressor stops, such that upon startup the compressor 20 can start against a low pressure differential. Typically, this valve 40 is only utilized during compressor shutdown for the above-described purpose.

In the embodiments described herein, the pressure equalization valve 40 opens for a period of time at startup of the compressor 20 or right after defrost while the compressor 20 is running. The time period that the pressure equalization valve 40 is open can be optimized for each system and operating condition. In some embodiments, the pressure equalization valve 40 is open for a predetermined time period, the predetermined time period based at least partially on an operating condition of the compressor and/or ambient conditions.

The valve could also be controlled based upon the discharge superheat. For example, the pressure equalization valve 40 may be closed when the discharge superheat of compressor refrigerant exceeds a threshold superheat of the compressor refrigerant. The threshold superheat may vary depending upon the particular system, but in some embodiments the threshold superheat of the compressor refrigerant ranges from about 5 degrees Celsius to about 60 degrees Celsius (about 41-122 degrees Fahrenheit). In an embodiment, the threshold superheat of the compressor is about 20 degrees Celsius (about 68 degrees Fahrenheit).

Figure 2:
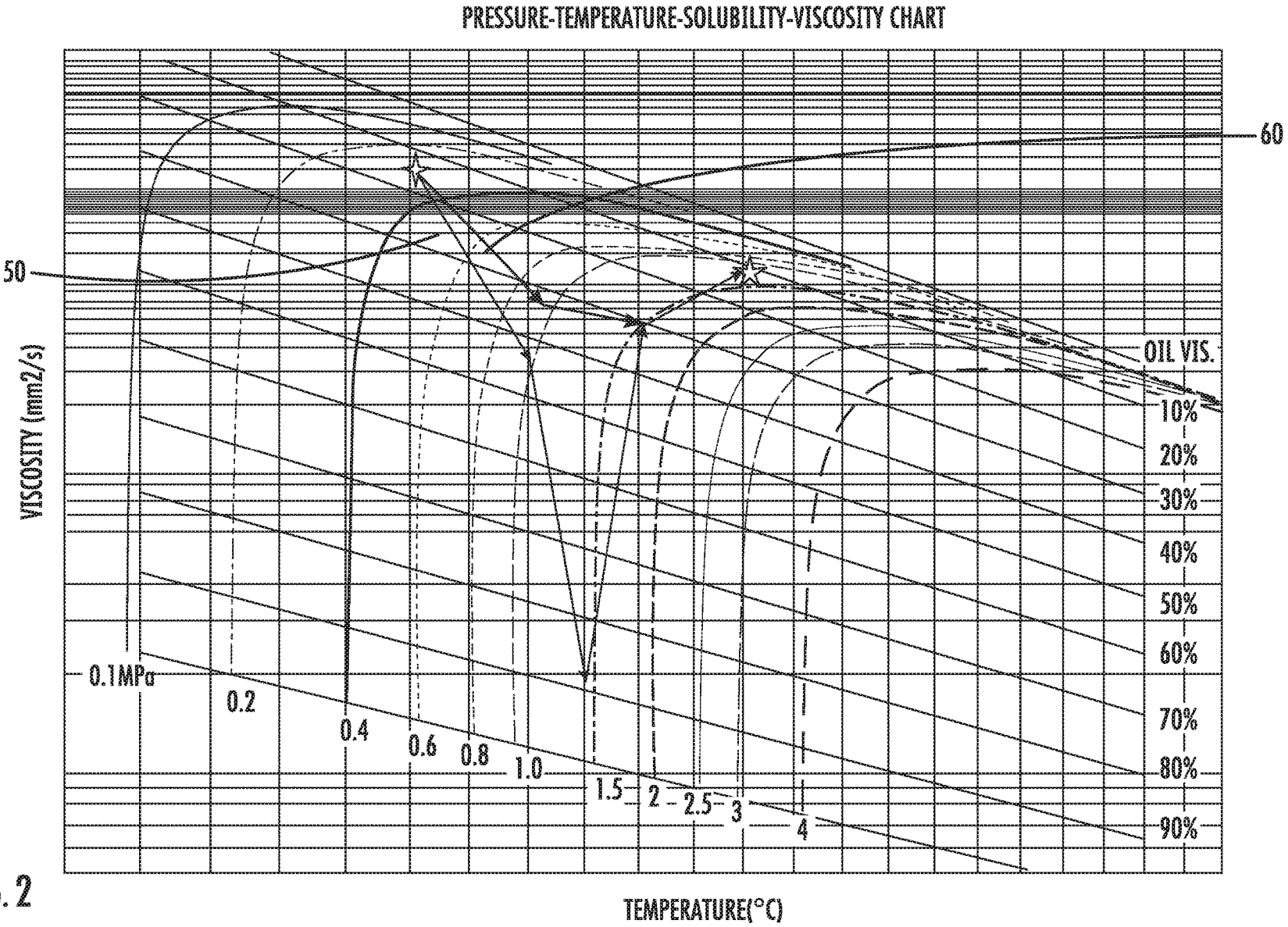
FIG. 2 is a pressure-temperature-solubility-viscosity chart of oil in the refrigeration system.

FIG. 2 illustrates a pressure-temperature-solubility-viscosity chart of oil utilized within the compressor 20. In particular, the plot shows a comparison between a prior process during startup (i.e., closed pressure equalization valve 40)—refrigerant-oil solubility curve 50—and the process disclosed herein (i.e., open pressure equalization valve 40 during compressor operation)—refrigerant-oil solubility curve 60. As shown, the refrigerant-oil viscosity quality of the oil is enhanced, as the dramatic increase in refrigerant-oil solubility associated with curve 50 is avoided with the embodiments disclosed herein. By allowing discharge oil and gas to bypass the system and be injected directly into the suction port 22 of the compressor 20, some oil that is discharged is returned and the heated discharge gas accelerates the heating process of the compressor 20. As the compressor 20 heats up, the refrigerant-oil solubility decreases and oil discharge is reduced. Thus, premature bearing wear is avoided.

Embodiments may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., a processor, apparatus or system) to perform one or more methodological acts as described herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the scope of the disclosure. Additionally, while various embodiments have been described, it is to be understood that aspects of the disclosure may include only some of the described embodiments. Accordingly, the disclosure is not to be seen as limited by the foregoing description, but is only limited by the scope of the appended claims.

What is claimed is:

1. A method of managing compressor oil for a HVAC system, the method comprising:

fluidly coupling a discharge port of a compressor with a suction port of the compressor with a pressure equalization valve; and operating the compressor while the pressure equalization valve is open;

wherein the pressure equalization valve is open for a predetermined time period, the predetermined time period based at least partially on an operating condition of the compressor.

2. The method of claim 1, wherein the pressure equalization valve is open during a startup operation of the compressor.

3. The method of claim 1, wherein the pressure equalization valve is closed when a discharge superheat of the compressor refrigerant exceeds a threshold superheat of the compressor refrigerant.

4. The method of claim 3, wherein the threshold superheat of the compressor refrigerant ranges from 5 degrees Celsius to 60 degrees Celsius.

5. The method of claim 4, wherein the threshold superheat of the compressor refrigerant is 20 degrees Celsius.

6. The method of claim 1, wherein the method is utilized with a residential HVAC system.

7. A method of managing compressor oil for a HVAC system, the method comprising:

fluidly coupling a discharge port of a compressor with a suction port of the compressor with a pressure equalization valve; and operating the compressor while the pressure equalization valve is open;

wherein the pressure equalization valve is open for a predetermined time period, the predetermined time period based at least partially on ambient conditions.

8. A HVAC system comprising:

a compressor comprising a suction port and a discharge port;

a refrigerant circulating throughout the HVAC system and through the compressor; and a pressure equalization valve fluidly coupling the discharge port of the compressor with the suction port of the compressor, the pressure equalization valve configured to open while the compressor is operating;

wherein the pressure equalization valve comprising an inlet, a first outlet and a second outlet, the first outlet leading to a vapor line, the second outlet leading to the suction port of the compressor.

9. The HVAC system of claim 8, wherein the pressure equalization valve is configured to close when a discharge superheat of the compressor refrigerant exceeds a threshold superheat of the compressor refrigerant.

10. The HVAC system of claim 9, wherein the threshold superheat of the compressor refrigerant ranges from 5 degrees Celsius to 60 degrees Celsius.

11. The HVAC system of claim 10, wherein the threshold superheat of the compressor refrigerant is 20 degrees Celsius.

12. A HVAC system comprising:

a compressor comprising a suction port and a discharge port;

a refrigerant circulating throughout the HVAC system and through the compressor; and a pressure equalization valve fluidly coupling the discharge port of the compressor with the suction port of the compressor, the pressure equalization valve configured to open while the compressor is operating;

wherein the pressure equalization valve is configured to open for a predetermined time period, the predetermined time period based at least partially on at least one of an operating condition of the compressor and ambient conditions.

* * * * *